United States Patent [19]

Achinger

[11] Patent Number: 4,846,251

[45] Date of Patent: Jul. 11, 1989

[54] APPARATUS FOR TRANSPORTING HORIZONTALLY SPLIT BOXLESS SAND CASTING MOLDS FOR FOUNDRY PURPOSES

[76] Inventor: Michael Achinger, Neuburger Strasse 40, D-8900 Augsburg, Fed. Rep. of Germany

[21] Appl. No.: 198,654

[22] PCT Filed: Jun. 5, 1985

[86] PCT No.: PCT/EP85/00270

§ 371 Date: Feb. 2, 1987

§ 102(e) Date: Feb. 2, 1987

[87] PCT Pub. No.: WO86/07293

PCT Pub. Date: Dec. 18, 1986

Related U.S. Application Data

[63] Continuation of Ser. No. 15,058, filed as PCT EP85/00270 on Jun. 5, 1985, published as WO86/07293 on Dec. 16, 1986, abandoned.

[51] Int. Cl.[4] ..... B22D 33/02

[52] U.S. Cl. ..... 164/323; 164/324; 198/803.01

[58] Field of Search ..... 164/13, 18, 27, 29, 164/322, 323, 324, 329, 330; 198/795, 803.01

[56] References Cited

U.S. PATENT DOCUMENTS

| | | | |
|---|---|---|---|
| 3,343,591 | 9/1967 | Lorang | 164/324 |
| 4,582,193 | 4/1986 | Larsson | 198/803.01 |

FOREIGN PATENT DOCUMENTS

| | | | |
|---|---|---|---|
| 3212259 | 1/1983 | Fed. Rep. of Germany | 164/323 |
| 3221539 | 3/1983 | Fed. Rep. of Germany | 164/323 |
| 51-16163 | 5/1976 | Japan | 164/323 |

*Primary Examiner*—Richard K. Seidel
*Attorney, Agent, or Firm*—Ralph M. Burton

[57] ABSTRACT

In an apparatus for the transportation of horizontally split, boxless sand casting molds (1) for foundry purposes, from a molding station via a casting station to the knocking-out point by means of a series of transport plates (5, 50) which are guided one against the other along a track and whose length in each case, in the direction of transport, is equal to or only slightly larger than the corresponding length of the casting mold placed on top in each case, each transport plate (5, 50) has, at least at one of its ends, preferably the end facing away from the molding station, a face strip (6) arranged substantially vertical to it and directed upward, which prevents an offset between transport plate and casting mold.

8 Claims, 2 Drawing Sheets

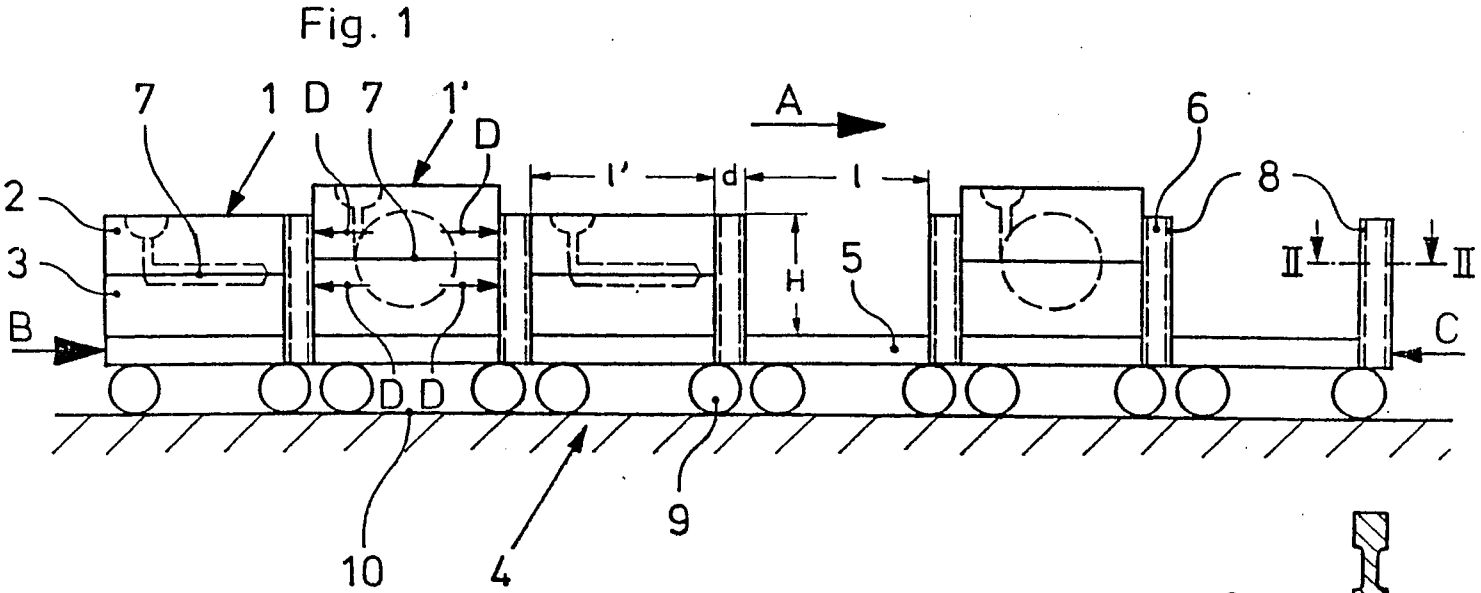
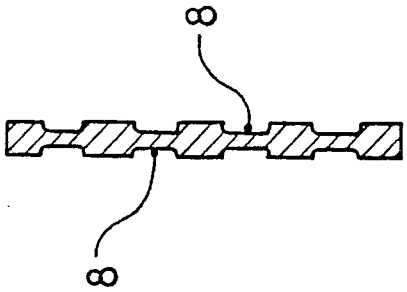
Fig. 2

APPARATUS FOR TRANSPORTING HORIZONTALLY SPLIT BOXLESS SAND CASTING MOLDS FOR FOUNDRY PURPOSES

This application is a continuation of U.S. application Ser. No. 015,028, filed as PCT EP85/00270 on Jun. 5, 1985, published as WO86/07293 on Dec. 18, 1987, now abandoned.

The invention relates to an apparatus for the transportation of horizontally split, boxless sand casting molds for foundry purposes from a molding station via a casting station to the knocking-out point by means of a series of transport plates which are guided one against the other along a track and whose length in each case, in the direction of transport, is equal to or only a little larger than the corresponding length of the casting mold placed on it in each case, and against which a drive engages.

An apparatus of this type is known (German Auslegeschrift No. 2,417,197), in which the supporting surfaces of the transport plates for the casting molds are not only of flat design, but also unlimited on all sides in such a way that, in the event of possible jolts, ie. sudden accelerations or decelerations, the casting molds on the transport plates can shift on the transport plates. Such an offset may impair not only the casting mold concerned itself, but also the neighboring casting mold against which it collides. Furthermore, a cast mold has the tendency to swell, ie. it expands under the effect of the casting, and can thus likewise impair adjoining casting molds, in particular those which have not yet been cast, since these themselves do not swell and can therefore easily be dented. Finally, problems may also arise in transferring the casting molds from one transport line to another transport line by once again an offset occurring or mold sand crumbling from the faces of a casting mold.

With respect to the problem of the swelling of a casting in a boxless casting mold, it should be mentioned that although attempts are made to avoid casting parts having different casting weights in one and the same series of successive sand casting molds, since in this case the swelling behavior likewise tends to be different according to the different casting weights, in such a way that a sand casting mold cast with a larger casting weight of course swells more, this cannot of course always be avoided.

The object underlying the invention is seen as creating an apparatus of the type specified at the start, in which no offset of the sand casting molds with respect to the transport plates can occur any longer and a swelling of the sand casting molds after casting cannot result in the possibility of neighboring sand casting molds, whether already cast or still empty, being touched or even impaired or damaged.

This object is achieved in the case of an apparatus of the type mentioned in that each transport plate has at least at one to its ends a face strip arranged substantially vertical to it and directed upward.

This face strip delimits the position of each new sand casting mold brought onto a transport plate from a molding station in the molding machine with respect to the preceding sand casting mold, namely by the face strip being arranged between the two molds. Sudden accelerations or decelerations can thus not lead to displacements or an offset of the sand casting molds on the associated transport plates. If it is desired, furthermore, to prevent particularly reliably that for instance the upper half of the sand casing mold, thus the half above the mold parting or separating line, is displaced or offset with respect to the lower half of the sand casting mold, it is advantageous to design the face strip as a face wall which has a height covering the parting line of the sand casting mold. The height of this face wall can be appropriately equal to the height of the sand casting mold. In any case, a touching of successive or neighboring sand casting molds owing to the swelling process of cast molds is prevented since, according to the invention, a face strip or face wall is always arranged between two successive sand casting molds. In this arrangement, the face strip is preferably arranged at the end of the transport plate facing away from the molding station in such a way that the respective sand casting molds delivered by the molding machine can be simply pushed in the direction of transport onto the transport plate.

Since it is desirable to prevent any swelling of cast sand casting molds at all, at least in the direction of transport, the drive appropriately engages at the end of the series of transport plates facing the molding station, while to achieve a compressive stress in the transport plates braking forces are applied at the other end, which are greater than any casting mold swelling forces but of course are less than the drive forces. This furthermore ensures that the drive forces are constantly transmitted via the transport plates.

If face strips are arranged at both ends of a transport plate, braking forces may be dispensed with because the swelling forces which are possibly exerted by a sand casting mold after its casting are absorbed by the two face strips and thus the platform alone. In the case of this embodiment, the pushing-on of a sand casting mold may be carried out from one side, perpendicular to the direction of transport. In order to prevent a lateral offset of the sand casting mold on its transport plate during pushing-on, an additional face strip or face wall may be provided as a stop along one side of the transport plate, of course along that side which is opposite the side from which pushing is performed.

Each face wall may be provided advantageously with grooves for gas removal, at least on the side facing its platform, and this further reduces the swelling tendency of the cast sand casting molds. It goes without saying that these grooves are continuous, ie. designed to be open on both sides and, furthermore, are appropriately arranged vertically and/or horizontally and at a distance from one another, so that, if applicable, a network of gas-removing grooves extends over the respective faces of each face wall facing the sand casting molds. If there is merely one face wall provided at one of the ends of a platform, said face wall shall be provided with gas removal grooves on both sides, since it adjoins two sand casting molds.

The invention and its advantageous developments are explained in more detail below with reference to exemplary embodiments shown in the drawing, in which:

FIG. 1 shows a first embodiment with a series of transport plates, in side view;

FIG. 2 shows a section along the line II—II in FIG. 1;

Figure 3:
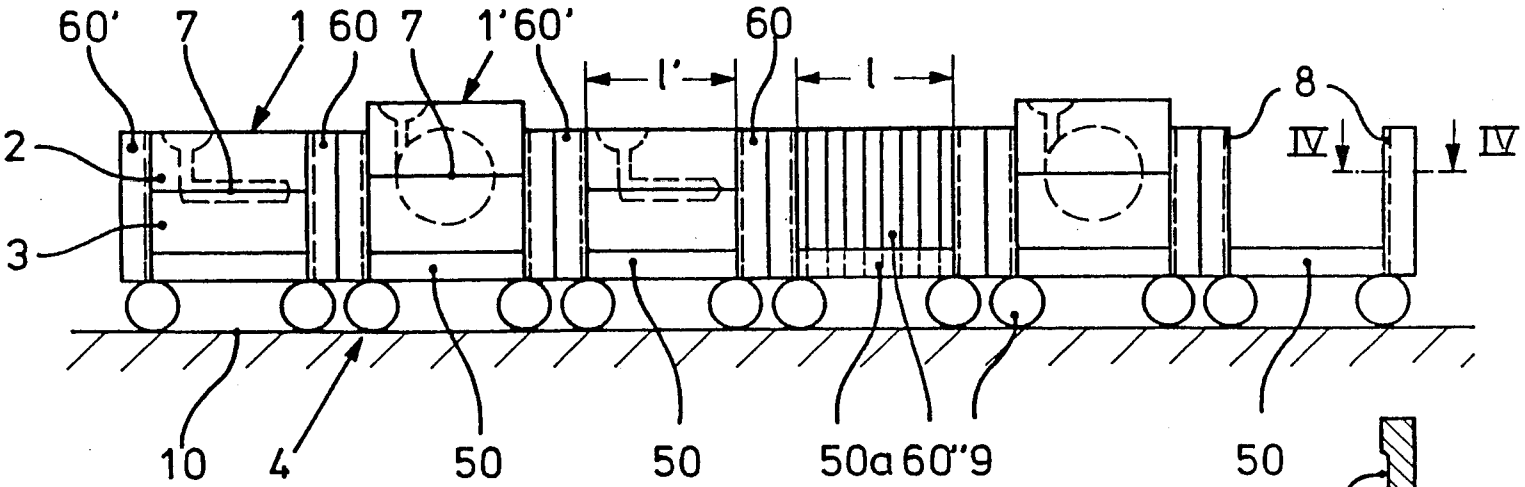
FIG. 3 shows a second embodiment.

FIG. 1 shows an apparatus for the transportation of sand casting molds 1 for foundry purposes, to be precise for the transportation of boxless sand casting molds 1 split horizontally into two halves 2 and 3. Transport takes place from a transport station (not shown) in arrow direction A via a casting station (likewise not shown) to the knocking-out point (not shown) by means of a series of transport plates 5 which are guided one against the other along a track 4 and whose length L in each case, in the direction of transport A, is equal to or only slightly larger than the corresponding length L of the casting mold 1 placed on it in each case. Furthermore, a drive (not shown) engages with the series of transport plates.

Each transport plate 5 has at its end facing away from the molding station (not shown) a face strip 6 arranged substantially vertical to it and directed upward. The drive forces are indicated by the arrow B. This drive B appropriately engages at the end of the series of transport plates 5 facing the molding station; furthermore, to achieve a compressive stress in the transport plates 5, braking forces according to arrow C are applied at the other end of the series of transport plates 5 and are greater than any casting mold swelling forces, but smaller than the drive forces B. This ensures that the transport plates 5 are constantly in contact one against the other, possibly in the way shown with the face strips 6 interposed between them. It is understood however that the face strips can equally well be placed on the transport plates 5 in such a way that their length available for the sand casting molds 1 is shortened by the thickness d of the face plates 6.

In the preferred embodiment shown, the face strip 6 is designed as a face wall which has a height H covering the parting line 7 of the respective sand casting mold 1. In the case of the sand casting molds 1, in the embodiment shown, this height H corresponds to the height of the sand casting molds. However, a particular advantage of the present invention is that sand casting molds having a different height and different casting weights can also be used in one and the same series of transport plates or one and the same mold line, as the sand casting molds 1' show. The swelling forces occurring in a sand casting mold 1' after casting according to arrows D are of course greater than in the case of the lower sand casting molds 1 having parts with smaller casting weights. Nevertheless, owing to the face strips 6 or face walls arranged between them, this does not result in impairment of the preceding or following sand casting molds 1 and 1', respectively. Furthermore, the transport plates 5 also remain in contact with one another, provided that the braking forces C are greater than the swelling forces D, but smaller than the drive forces B.

As emerges particularly clearly from FIG. 2, the face strips 6 or face walls are provided on both sides with continuous grooves 8 for gas removal. These grooves may be arranged, in a way not shown, not only vertically but also horizontally, in the latter case a network (not shown) of grooves being produced which are in each case arranged at a distance from one another.

Advantageously, in the case of the apparatus according to the invention it is insignificant whether on some occasions a transport plate remains unoccupied as is the case with the transport plates 5 shown in FIG. 1 in the center and at the end. The respective adjoining sand casting molds 1 and 1' are nevertheless supported on either side by face strips 6 or face walls. This support ensures during a transfer of the sand casting molds with the transport plates from one track to the other that nothing can crumble, at least at one face, namely the face up against a face strip 6 or face wall and, moreover, also that no displacement between the mold halves 2 and 3 on the one hand and the transport plate 5 on the other hand can take place in this operation.

Figure 4:
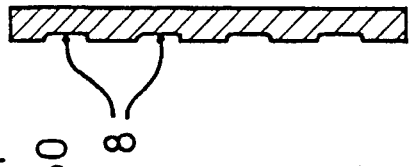
FIG. 4 shows a section along the line IV—IV in FIG. 3.

In the second embodiment represented in Figures 3 and 4, face strips or face walls 60, 60' are arranged at both ends of a transport plate 50. This makes it possible to dispense with braking forces since, even in the case of a broken chain of transport, ie. with a distance between two transport plates 50, the sand casting molds 1, 1' concerned cannot swell since they cannot swell between the face walls 60, 60'. Furthermore, in the embodiment shown, an empty transport plate **50*a* is shown as an example, an additional stop strip 60'' being provided along one of its sides such that the sand casting mold concerned can be pushed up from the side until in contact with this additional stop strip 60'', so that said casting mold, surrounded on three sides, precisely assumes its position on the transport plate 50*a*. It goes without saying that this stop strip 60'' as well, like all face strips 6, 60, 60', may be designed as a wall. The expression "from the side" means of course in FIG. 3 "perpendicular to the plane of the drawing". FIG. 4 shows a face wall with gas removal grooves 8** provided merely on one side, in each case facing the platform. The other side does not of course require any grooves in this embodiment of the apparatus.

Moreover, the same reference symbols have been used in this embodiment as in the embodiment according to FIGS. 1 and 2.

Even if the text above constantly refers to transport plates 5, which may be transported for example on trains of rollers or the like, it should nevertheless be pointed out that in the embodiments shown the transport plates 5 have been developed further, by wheels indicated at 9, into transport cars which run on a surface 10 forming the track. It goes without saying that the invention is not restricted to the use of such cars.

I claim:

1. Apparatus for the transportation of horizontally split, boxless sand casting molds for foundry purposes from a molding station via a casting station to the knocking-out point by means of a series of horizontal mold underlay plates which are guided one against the other along a track and whose length in each case, in the direction of transport, is equal to or only a little larger than the corresponding length of the casting mold placed on it in each case, and against which a drive engages, characterized in that each mold underlay plate has at least at one of its ends a substantially vertical face strip rigidly attached thereto and extending upwardly for directly engaging throughout a major portion of its height a boxless sand casting mold resting on the underlay plate to prevent displacement of the casting mold both above and below the horizontal split; and said face strip having in each case a height covering the horizontal split of the sand casting mold.

2. Apparatus according to claim 1, characterized in that the face strip is arranged at the end of the mold underlay plate facing away from the molding station.

3. Apparatus according to claim 1 or 2, characterized in that the drive engages at the end of the series of mold underlay plates facing the molding station.

4. Apparatus according to claim 2, characterized by brake means for imposing a braking force at the other end of the series of underlay plates from the drive greater than any casting mold swelling forces.

5. Apparatus according to claim 1, characterized in that face strips are arranged at both ends of a mold underlay plate.

6. Apparatus according to claim 1, characterized in that a stop strip is provided along one side of teach mold underlay plate and rigidly attached thereto and extending upwardly therefrom beyond the horizontal split of the sand casting mold.

7. Apparatus according to claim 1, characterized in that each face strip is provided with continuous grooves for gas removal, at least on the side facing its mold underlay plate.

8. Apparatus according to claim 7, characterized in that the grooves are arranged vertically and/or horizontally and at a distance from one another.

* * * * *